United States Patent [19]

Janky et al.

[11] Patent Number: 4,467,294

[45] Date of Patent: Aug. 21, 1984

[54] WAVEGUIDE APPARATUS AND METHOD FOR DUAL POLARIZED AND DUAL FREQUENCY SIGNALS

[75] Inventors: James M. Janky; Albert L. Horley, both of Mountain View, Calif.

[73] Assignee: Vitalink Communications Corporation, Mountain View, Calif.

[21] Appl. No.: 331,727

[22] Filed: Dec. 17, 1981

[51] Int. Cl.[3] ..... H01P 1/161; H01P 5/16

[52] U.S. Cl. ..... 333/126; 333/21 A; 333/135; 333/208

[58] Field of Search ..... 333/126, 135, 21 A, 333/202, 204, 208

[56] References Cited

U.S. PATENT DOCUMENTS

| | | | |
|---|---|---|---|
| 3,614,672 | 10/1971 | Newbould | 333/208 X |
| 3,825,863 | 7/1974 | Meier | 333/253 X |
| 3,914,713 | 10/1975 | Konishi et al. | 333/1.1 X |
| 3,978,434 | 8/1976 | Morz et al. | 333/135 |
| 4,047,128 | 9/1977 | Morz | 333/21 A X |
| 4,167,715 | 9/1979 | Ohm | 333/21 A X |
| 4,176,330 | 11/1979 | DiTullio et al. | 333/135 X |
| 4,233,579 | 11/1980 | Carlson et al. | 333/204 |
| 4,344,048 | 8/1982 | Morz | 333/135 |

*Primary Examiner*—Paul L. Gensler
*Attorney, Agent, or Firm*—Donald C. Feix

[57] ABSTRACT

A waveguide apparatus guides a first pair of horizontally polarized transmit and receive frequency signals independently of and in parallel with a second pair of vertically polarized transmit and receive frequency signals. The waveguide apparatus is constructed to operate across the 3.7 to 6.425 GigaHertz band with a very narrow bandwidth for the transmit frequency and a very narrow bandwidth for the receive frequency and with a single size of rectangular waveguide for separating the transmit and receive frequencies. This construction simplifies frequency separation filtering techniques and provides effective operation over this broad band with an apparatus which is efficient in terms of space, compact and implemented by a simple package.

22 Claims, 10 Drawing Figures

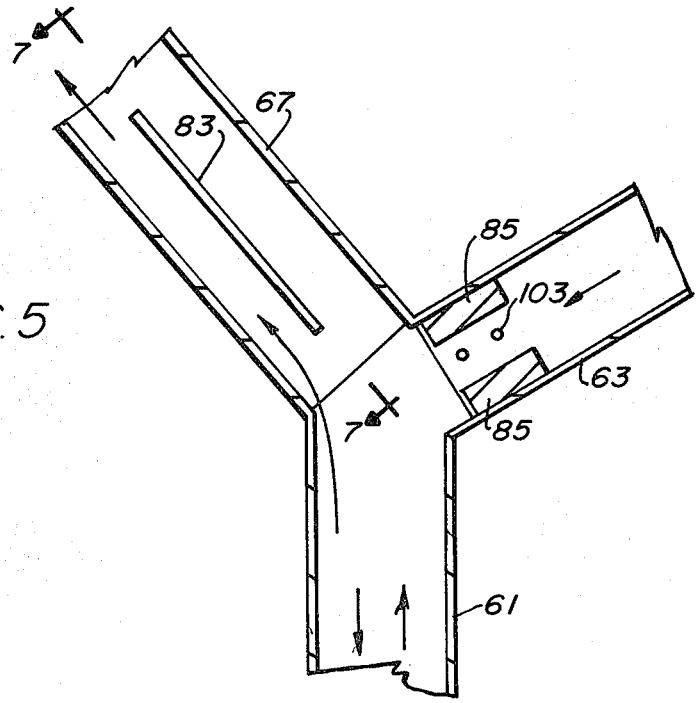
FIG. 5
FIG. 6
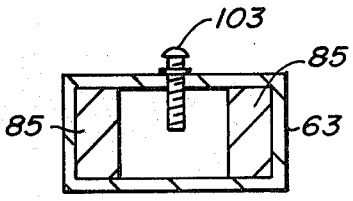
FIG. 8
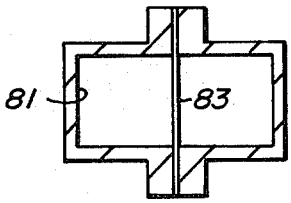
FIG. 7
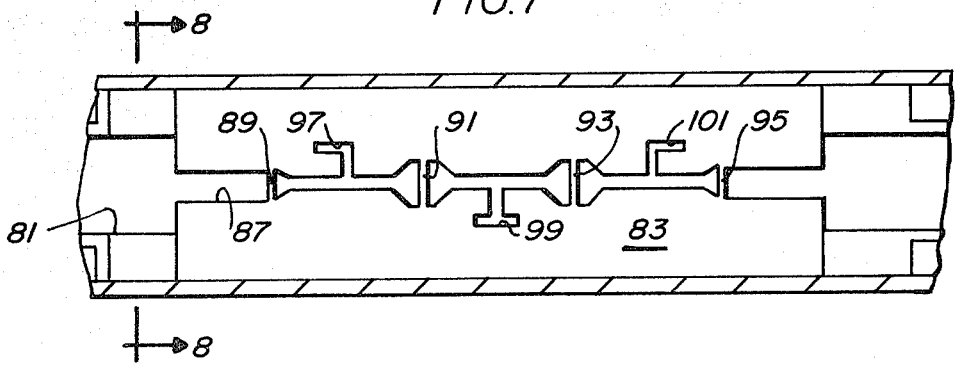

WAVEGUIDE APPARATUS AND METHOD FOR DUAL POLARIZED AND DUAL FREQUENCY SIGNALS

BACKGROUND OF THE INVENTION

This invention relates to waveguide apparatus and methods for guiding transmit and receive signals at an earth station of a satellite communication system. This invention relates particularly to a waveguide apparatus for guiding two pairs of orthogonally polarized transmit and receive signals.

Antennas for earth stations of satellite communication systems may be used to receive a signal from a satellite and may also be used to transmit a signal to a satellite by associating appropriate receiver and transmitter units with a feed horn of the antenna.

The capacity of the earth station can also be increased by simultaneously transmitting and receiving two pairs of signals on the same transmit and the same receive frequencies if the two pairs of transmit and receive signals are polarized, because the two pairs of frequencies can be separated according to the sense of polarization of each pair.

The dual polarization, dual frequency operation thus provides the communications user with the opportunity to obtain dual-path operation with only one antenna. The dual-path operation can be used to double the capacity and can be relied on as dual-path redundancy to permit continued operation of at least one path in the event there is a failure of a component in the other path.

The prior art waveguide apparatus and methods that have been used to obtain polarization separation and frequency separation at earth stations have often involved rather large and relatively complex and costly apparatus.

SUMMARY OF THE INVENTION

It is a primary object of the present invention to overcome the problems presented by waveguide apparatus and methods used in the prior art for the transmission and reception of dual polarized, dual frequency signals.

It is a specific object of the present invention to construct a waveguide apparatus for guiding two pairs of orthogonally polarized transmit and receive frequency signals that is mechanically small enough and robust enough to enable the waveguide apparatus to be used as a structural member for locating and supporting all of the earth station electronics at the antenna and by the antenna support structure. The polarization/frequency separator/combiner of the present invention permits the installation of essential receiver and transmitter apparatus at a point very close to the antenna feed, thereby substantially reducing the transmission losses, especially in the transmit legs.

It is a specific object of the present invention to construct the waveguide apparatus so that all four of the transmit and receive signal ports terminate in a common plane to thereby minimize or eliminate the need for cable runs between the waveguide and the transmitter/-receiver units and to also permit each of the transmitter and receiver units to be a field replaceable unit which can be removed or replaced while the earth station is in operation and without interfering with the functioning of the other three signals.

It is a further object of the present invention to construct the waveguide apparatus as a symmetrical unit which performs all of the required redirection of frequency signals in minimum pathlengths to substantially eliminate spurious modes and higher order frequencies of the kind which could interfere with the signals being transmitted and received.

It is yet a further object of the present invention to maintain isolation between the receive and transmit ports of each polarized pair of frequency signals by a planar filter and susceptance block structure which provides a high degree of isolation with a minimum of structure.

A further object of the present invention is to construct a waveguide apparatus which can be produced at low cost by simple fabrication techniques such as die casting or sheet metal forming.

A waveguide apparatus constructed in accordance with one embodiment of the present invention guides a first pair of horizontally polarized transmit and receive frequencies independently of and in electrical parallel with a second pair of vertically polarized transmit and receive frequencies. The waveguide apparatus guides the polarized pairs of frequencies between a feed horn and related transmitter and receiver units.

The waveguide apparatus includes a polarization junction which is connected to an end of the feed horn and which is effective to separate the horizontally polarized receive frequency from the vertically polarized receive frequency as the receive frequencies flow from the horn toward the receiver units. The polarization junction is effective to guide the separated horizontally and vertically polarized transmit frequencies into joint flow through the common feed horn to the antennae.

The polarization junction includes a throat, two side ports and septums in the throat for dividing the E-field of the horizontally polarized receive frequency in two equal parts while turning each of the two parts of the E-field ninety degrees from the direction of flow from the feed horn to a related side port. The septums pass the vertically polarized frequencies in a straight line through the polarization junction.

The waveguide apparatus includes a first frequency separator for separating the vertically polarized transmit and receive frequencies and a second frequency separator for separating the horizontally polarized pair of transmit and receive frequencies.

Each of the frequency separators comprises a generally Y-shaped waveguide having a leg portion for guiding both the transmit and receive frequencies, a first branch providing a port for the transmit frequency, a second branch providing a port for the receive frequency, and a junction at which the transmit port, the receive port, and the leg portion of the Y-shaped frequency separator join together.

A planar filter is positioned in the receive port and has a bandpass structure for passing the receive frequency and band-stop structure for stopping the transmit frequency. The bandpass structure and the band-stop structure are interspersed in the planar filter.

Susceptance blocks are mounted in the transmit port for narrowing down the waveguide to prevent receive frequency energy from propagating through the transmit frequency port. Tuning screws compensate for the discontinuity introduced by the blocks and restore the desired impedance match.

A symmetrical coupling connects the ports of the polarization junction with the frequency separator for the horizontally polarized transmit and receive frequencies.

The coupling includes two symmetrical 180° H-plane bends with each bend having one end connected to a related port of the polarization junction.

The coupling also includes two ninety degrees E-plane bends and a Southworth junction. One end of each E-plane bend is connected to a related H-plane bend and the other end of the E-plane bend is connected to the Southworth junction. The Southworth junction is connected to the leg portion of the frequency separator for the horizontally polarized pair of frequencies, and the leg portion of the frequency separator for the vertically polarized pair of frequencies is connected directly to the straight through portion of the polarization junction.

Waveguide apparatus having structural features and effective to function in the ways described above constitute further, specific objects of this invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 2 shows the portion of the FIG. 1 earth station encircled by the arrows 2—2 in FIG. 1.

FIG. 5 is a cross section view, taken generally along the line and in the direction indicated by the arrows 5—5 in FIG. 4, showing details of a frequency separator structure for separating the transmit and receive frequencies in the vertically polarized pair.

FIG. 6 is a cross section view, taken along the line and in the direction indicated by the arrows 6—6 in FIG. 4, showing details of the susceptance blocks and tuning screws located in the transmit frequency port.

FIG. 7 is a plan view, taken along the line and in the direction indicated by the arrows 7—7 in FIG. 5, showing details of a planar filter in the receive frequency port.

FIG. 8 is an end view, taken along the line and in the direction indicated by the arrows 8—8 in FIG. 7.

DESCRIPTION OF THE PREFERRED EMBODIMENTS

Figure 1:
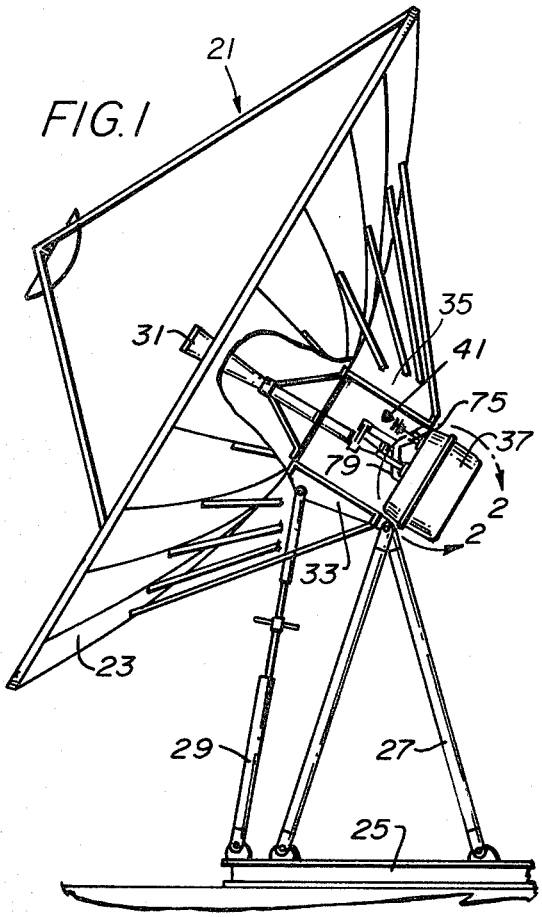
FIG. 1 is a side elevation view of an earth station incorporating a waveguide apparatus constructed in accordance with one embodiment of the present invention.

FIG. 1 shows an earth station antenna installation 21 incorporating a waveguide assembly constructed in accordance with one embodiment of the present invention.

The antenna installation 21 includes a dish shaped antenna 23 supported by a support frame 25 and legs 27 and 29.

A feed horn 31 is mounted, by structural members 33 and 35, on the legs of the support frame 25.

Figure 3:
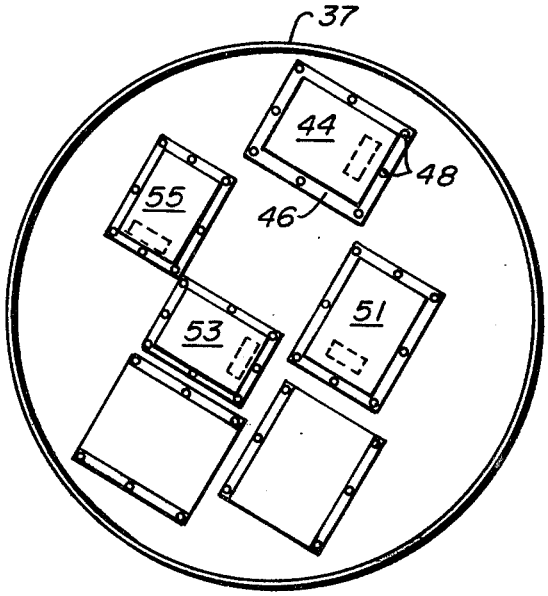
FIG. 3 is an end view taken generally along the line and in the direction indicated by the arrows 3—3 in FIG. 2.
Figure 2:
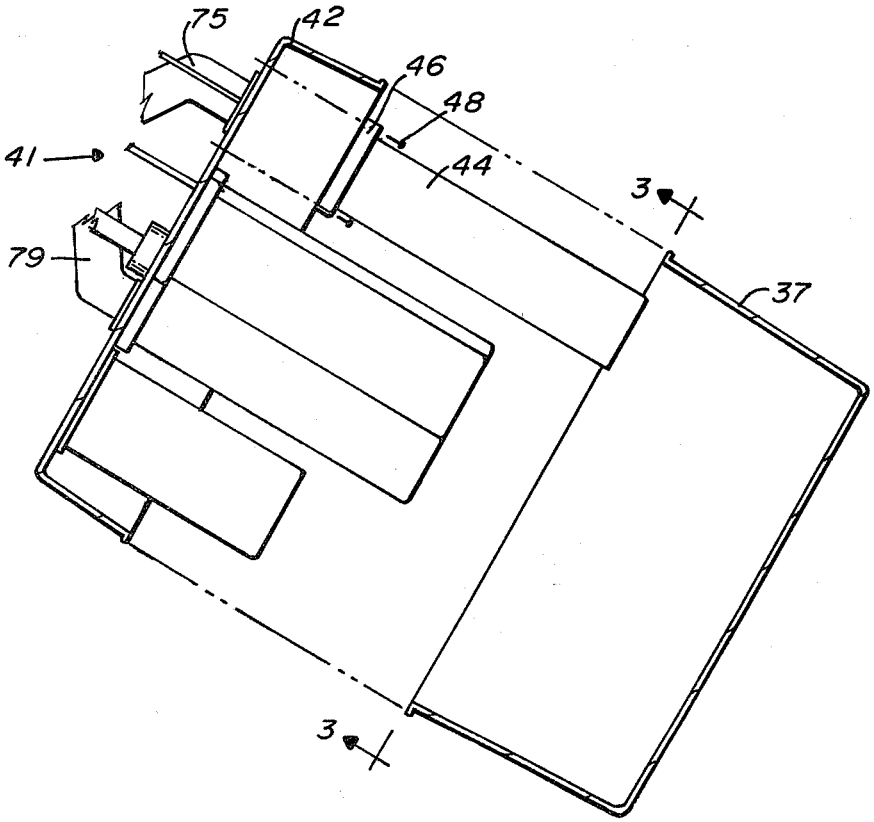
FIG. 2 is an enlarged view, partly in cross section to show details of construction, of a sealed assembly containing transmitter and receiver units and mounted directly on one end of the waveguide apparatus of the present invention.

Transmitter and receiver units for transmitting and receiving dual polarized, dual frequency signals are contained within a housing 37 (shown in more detail in FIGS. 2 and 3).

The housing 37 is preferably a sealed unit suitable for pressurization.

A waveguide apparatus 41 supports the housing 37 directly from the feed horn 31. The waveguide apparatus (as will be described in more detail below with reference to FIGS. 4–10) has four ports at the end associated with the housing 37, and the four ports terminate in a common plane.

As shown in FIGS. 2 and 3, the housing 37 has a mother plate 42 mounted directly on the ends of the four ports of the waveguide apparatus 41. The transmitter and receiver units are attached directly to the mother plate 42, and thus, in effect, directly to the ports of the waveguide apparatus, by plug-in connections. As shown in the exploded portion of FIG. 2, the transmitter unit 44 for the horizontally polarized transmit frequency is connectable to the mother plate 42 by a flange 46 and bolts or cap screws 48. Similarly, the transmitter 51 for the vertically polarized transmit frequency, the receiver unit 53 for the horizontally polarized receive frequency, and the receiver unit 55 for the vertically polarized receive frequency are all removable, plug-in, field replaceable units which can be individually installed and replaced in the field.

The waveguide apparatus 41 (as will become more apparent from the description to follow) permits each field replacement unit 44, 51, 53 and 55 to be installed or replaced while the remaining units continue in operation. The maintenance or repair of any individual transmitter or receiver unit therefore does not bring down the system. Instead, the system continues to operate, though at a reduced capacity, when one of the transmitter or receiver units is removed or replaced.

The waveguide apparatus 41 is physically compact, less than 0.5 meters long, and is structurally robust. This construction permits the waveguide apparatus to be used as a structural member to locate the electronics at and on the antenna mounting.

Figure 4:
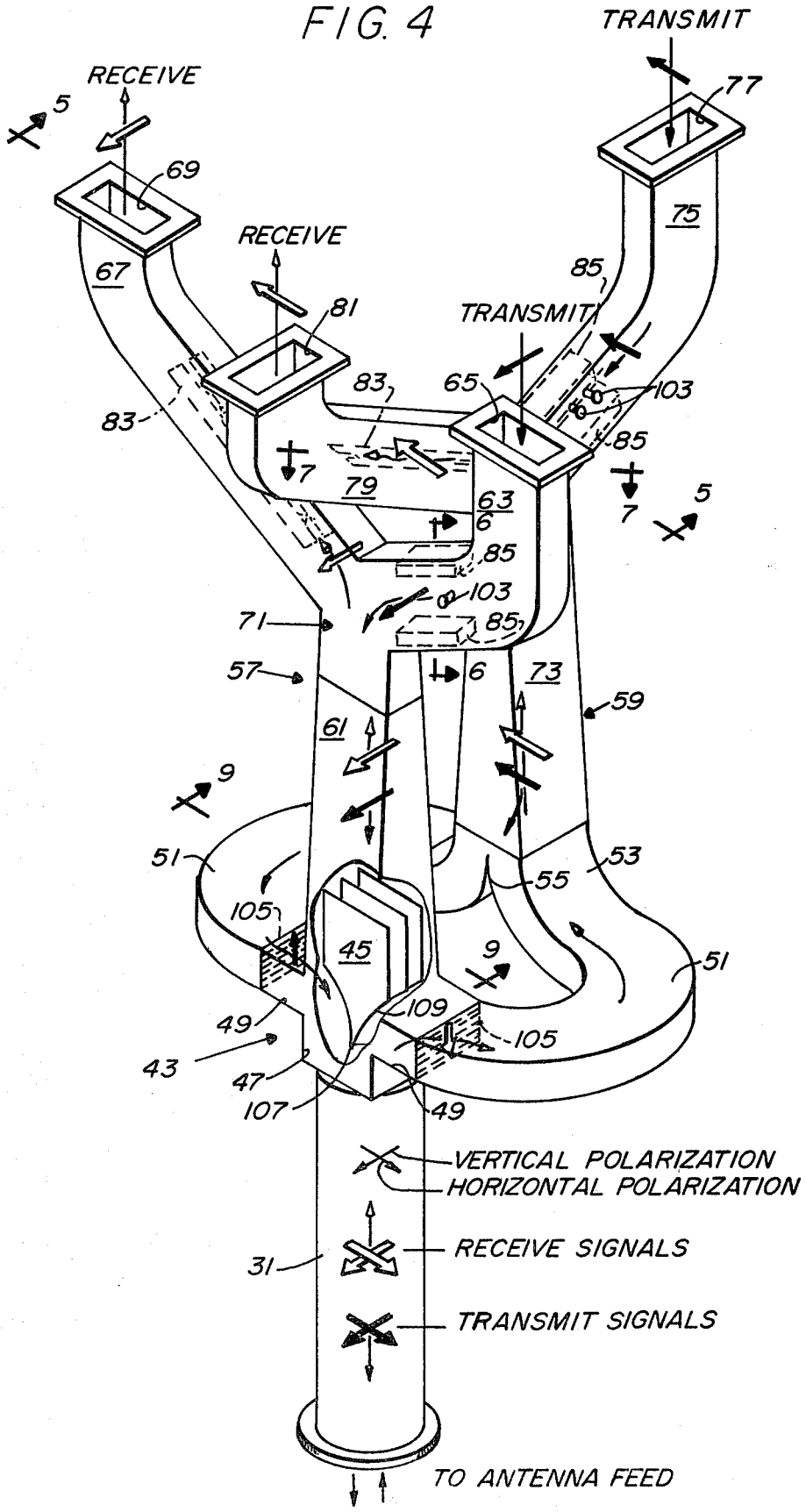
FIG. 4 is an isometric view showing a waveguide apparatus for dual polarized and dual frequency signals constructed in accordance with one embodiment of the present invention.

FIG. 4 shows how the waveguide apparatus 41 is constructed to guide a first pair of horizontally polarized transmit and receive frequencies independently of and in electrical parallel with a second pair of vertically polarized transmit and receive frequencies. The two pairs of frequencies are guided between the feed horn 31 and the related transmitter and receiver units 44, 51, 53 and 55 (see FIG. 3) by the waveguide apparatus 41.

In a specific embodiment of the invention the transmit signal frequency in each pair is in the range from 5.925 to 6.425 GigaHertz (GHz) and the receive signal frequency in each pair is in the range from 3.7 to 4.2 GHz.

These pairs of transmit and receive signals are combined orthogonally, that is at right angles to one another in space, in the transmit direction of flow (as shown by the solid black arrows in FIG. 4) and are separated orthogonally in the receive direction of flow (as shown by the arrows in outline in FIG. 4) in a polarization junction 43.

The vertical polarization is defined to be that which is oriented as shown by the arrow with the legend "vertical polarization". The vector of the vertical polarization is perpendicular to the septums 45 in a throat of the junction 43.

The horizontal polarization vector is aligned parallel to the plane of the septums 45.

The junction 43 has two side ports 49.

Two, symmetrical H-plane bends 51 are connected to the ports 49. Each of the H-plane bends is a 180° bend.

Two E-plane bends 53 are connected to the H-plane bends 51. The E-plane bends 53 join together in a Southworth junction 55.

The junction 55 is axially offset from (and in parallel alignment with) the straight through direction of flow in the throat 47 (see FIG. 9) of the polarization junction 43.

A first frequency separator structure 57 for separating the vertically polarized pair of transmit and receive frequencies is connected directly to the polarization junction 43.

A second frequency separating structure 59 for separating the horizontally polarized transmit and receive frequencies is connected to the junction 55.

Each of the frequency separator structures 57 and 59 is a generally Y-shaped waveguide having a leg portion for guiding both the transmit and receive frequencies, a first branch providing a port for the transmit frequency, a second branch providing a port for the receive frequency, and a junction at which the transmit port, the receive port and the leg portion of the Y-shaped waveguide join together.

Thus, the frequency separator 57 has a leg portion 61, a branch 63 providing a port 65 for the transmit frequency, a branch 67 providing a port 69 for the receive frequency and a junction 71.

The second frequency separator 59 for the horizontally polarized frequencies has a leg portion 73, a branch 75 providing a port 77 for the transmit frequency, a branch 79 providing a port 81 for the receive frequency and an (unnumbered) junction like the junction 71 of the first frequency separating structure 57.

Each of the leg portions 61 and 73 is square in cross section at the lower end and tapered toward the upper end. The legs taper inwardly from the respective ends connected to the polarization junction 43 and the junction 55 to the ends connected to the junctions with the related transmit and receive ports.

The taper of the leg portion 61 is dimensioned such that all frequencies for the horizontal polarization become cut off in this leg portion 61.

Similarly the taper in the leg portion 73 is dimensioned such that all frequencies in the vertical sense of polarization become cut off in the leg portion 73. However, the vanes 105 located in either aperture of the side ports 49 substantially prevent any vertically polarized signals from passing through the side arms.

In a specific embodiment of the present invention each of the ports 65, 69, 77 and 81 is rectangular shaped and has dimensions of 44 millimeters by 20.5 millimeters for guiding a transmit signal frequency in a range from 5.925 to 6.425 GHz and a receive signal frequency in a range from 3.7 to 4.2 GHz. These dimensions for the port have special and unexpected utility in a waveguide operated with these signal frequencies (which depart from the classic two-to-one broad wall to narrow wall aspect ratio). These specific waveguide dimensions provide broadband performance in this specific frequency range. The dimensions are critical for the frequency range because a change of the narrow wall of only a millimeter jeopardizes the performance. The waveguide dimensions match the frequency band identically and do not support any additional higher order modes and also do not cut off until about 3.4 GHz. In this specific embodiment the waveguide apparatus 41 provides an insertion loss (from the feed horn 31 to the ports 65, 69, 77 and 81) on the order of 0.5 dB, the polarization junction 43 provides at least 25 dB isolation between the horizontal and vertical polarization senses, and the isolation between the transmit port and the receive port in each frequency separator 71 and 73 is on the order of 60 dB. The waveguide apparatus 41 thus provides a net of 85 db minimum isolation from one transmitter to an oppositely polarized receiver because the waveguide apparatus 41 provides 25 dB through the junction 43 and another 60 dB through one of the frequency separators.

The isolation between the transmit port and the receive port in each frequency separator is provided by a planar filter 83 in the receive port and susceptance blocks 85 in the transmit port.

Figure 10:
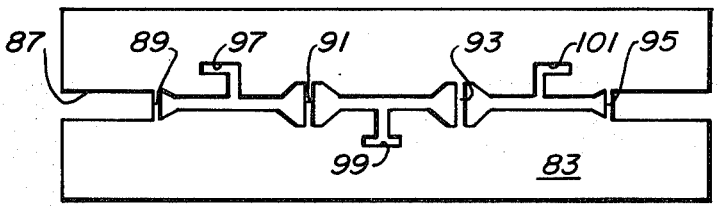
FIG. 10 is a diagram (in the lower part of FIG. 10) illustrating insertion loss versus frequency and correlated to the axial locations of the bandpass and bandstop structure of the planar filter shown in the top part of FIG. 10.
Figure 10:
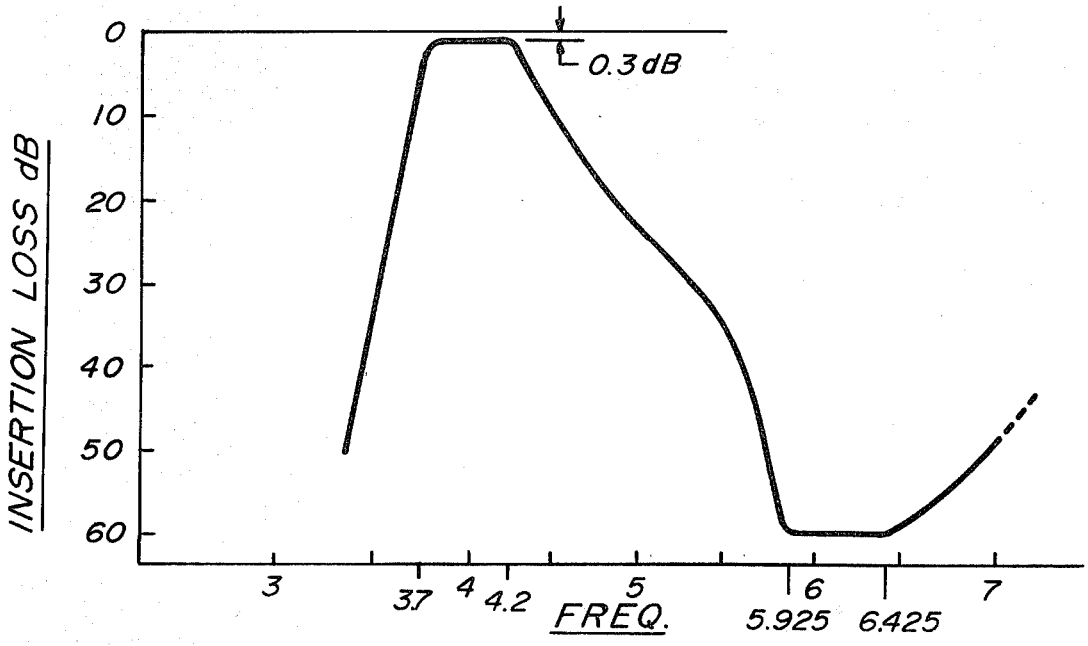

FIGS. 7 and 8 are enlarged views showing the structure of the planar filter 83, and FIG. 10 shows the correlation between the structure of the planar filter 83 and a plot of the insertion loss versus frequency at the locations of the various structural features of the filter 83.

As best shown in FIG. 7, the planar filter 83 comprises a thin rectangular strip of metal with a channel 87 that runs along the central part of the length of the strip. The strip is micro etched to leave four thin wires 89, 91, 93 and 95 extending across the channel 87 and to provide cut-outs 97, 99 and 101 in the edges of the channel 87.

As illustrated by the legends and as shown by the diagram in FIG. 10, the thin wires 89, 91, 93 and 95 provide bandpass structure while the cut-outs 97, 99 and 101 provide band-stop structure.

The bandpass structure is interspersed with the band-stop structure in the planar filter 83 to provide the results shown in the plot of insertion loss versus frequency in the bottom part of FIG. 10.

The band-stop structure provides the equivalent of a short circuit at 6 GHz across the 4 GHz receive port 81 while the bandpass structure allows the 4 GHz energy to flow through the port 81 in the direction indicated in FIG. 4.

The planar filter 83 also provides a preselection filter for any low noise amplifier that is attached to the 4 GHz port 81.

The planar filter 83 positioned in the port 81 behaves like a flat plate (even through it is just a thin strip) in reflecting the 6 GHz energy at the inlet to the port 81.

The strip is positioned in the port to reflect the 6 GHz energy back into the junction in phase with the 6 GHz energy flowing into the leg 73 from the port 77.

The 4 GHz energy flowing through the port 81 is prevented from propagating through the transmit port 77 by the susceptance blocks 85. These blocks 85 essentially narrow the waveguide down so that the waveguide is beyond cutoff for the 4 GHz energy. The 4 GHz energy sees the passage between the susceptance blocks as if it were a short circuit so that most of that energy then passes through the 4 GHz port 81 and through the bandpass filter structure of the planar filter 83.

Tuning screws 103 are positioned between the susceptance blocks 85 to tune out the effects on the waveguide of the susceptance blocks. These tuning screws provide the compensating susceptance to balance out the susceptance introduced by the blocks.

The isolation between the receive and transmit signals in the vertically polarized frequency separator 57 is obtained in the same way as in the frequency separator 59 for the horizontally polarized frequencies, and corresponding reference numerals are used for corresponding parts in the two frequency separators.

Returning now to a description of the structure of the polarization junction and associated coupling structure, the polarization junction 43 has vanes 105 in the ports 49. In a specific embodiment of the present invention, using the frequencies noted above, there are three vanes 105 in each port 49.

Because the vanes 105 are spaced closely together (compared to a wave length of the vertically polarized frequency) and because of boundary conditions, the vanes look as if they were a nearly solid wall to any wave which is vertically polarized.

The horizontal polarization passes right through these vanes 105 and into the H-plane bends 51, as will be described in more detail shortly.

The vertical polarization passes straight through the polarization junction 43 and into the leg 61 in the receive frequency direction of flow. The vertical polarization also passes straight through the polarization junction 43 from the leg portion 61 to the feed horn 31 in the transmit direction of flow. The septums 45 do not materially impede the flow of energy for the vertically polarized signals. The septums merely divide the E-field of the vertical polarization equally among the septums, and the divided E-fields recombine to add up to the the main field again after passing through the septums 45.

The vanes eliminate leakage of the vertical polarization through the H-plane bends 51 because of the boundary conditions presented by these vanes 105 to the vertical polarization.

Figure 9:
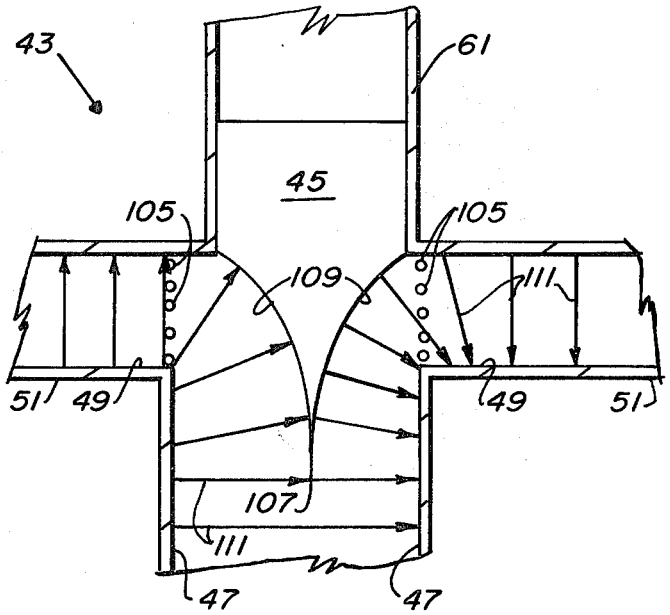
FIG. 9 is a cross sectional view, taken along the line and in the direction indicated by the arrows 9—9 in FIG. 4, showing details of the polarization junction and septums for dividing the E-field of the horizontally polarized receive frequency in two equal parts.

The action of the septums 45 on the E-fields of the horizontal polarization is illustrated in FIG. 9. The septums 45 have lower ends which are tapered to apexes 107, and this shape of the septums couples the horizontally polarized energy into the desired modes of propagation in the two side arms. It's as if the curved edges 109 were continuous sides (extending perpendicular to the plane of the paper in FIG. 9) of a waveguide wall. The E-field for the horizontal polarization is indicated by the arrows 111 in FIG. 9. Since the E-field must go to zero when it is tangential to a conductive surface, the horizontal polarization therefore cannot pass through the septums and into the leg 61 of the waveguide for the vertical polarization. The E-field of the horizontal polarization is instead divided into two equal parts by the septums 45, and each of the two equal parts of the E-field is guided through the vanes 105 in the ports 49 to the related H-plane bend 51.

The horizontally polarized receive signal frequencies then flow through the H-plane bends 51 (as indicated by the direction arrows in FIG. 4) and into the E-plane bends 53. The two divided E-fields of the horizontally polarized receive frequency are then recombined in the Southworth junction at the lower end of the horizontal polarization frequency separator 59.

The E-field of the horizontally polarized transmit frequency is divided into two equal parts by the Southworth junction. These two parts pass through the E-plane bends 53 and the H-plane bends 51 and are recombined into a single E-field at the apexes 107 of the septums 45.

The junction 43 and the coupling provided by the H-plane bends 51, the E-plane bends 53 in the Southworth junction provides a symmetrical structure which enables the polarization separation between the horizontal and vertical senses of the frequencies to be obtained without tuning and permits a very broadband structure and broadband operation to be produced. Broadband operation is very important in the specific embodiment of the invention, using frequencies in the range from 3.7 to 4.2 GHz, because the frequency range from 3.7 to 6.425 GHz represents almost an octave band width.

The four port configuration with dual orthogonal polarizations of this invention enables the communications user to obtain dual thread (or parallel path operation) with a structure that is quite inexpensive. The waveguide of the present invention is inexpensive because of its simplicity. The simplicity arises from the use of the symmetrical junction and coupling means as described above. The symmetrical construction of the present invention accomplishes the polarization separation and the frequency separation with structure that is simple and compact and yet effective to operate well within the performance specifications required.

The structural configuration of the waveguide 41 also permits the waveguide apparatus to be manufactured at low cost because all components can be die cast or fabricated from sheet metal and do not have to be made by more expensive techniques, such as, for example, electroforming.

In a specific embodiment of the present invention, using the frequencies in the 3.7 to 6.425 GHz range as noted above, the throat 47 of the polarization junction has a square cross section 44 millimeters by 44 millimeters in dimension. At the frequencies of interest this dimension of the square guide produces an impedance which is almost identical to the wave impedance of a circular pipe whose dimension is 52.3 millimeters in diameter. Consequently no impedance matching structure need be implemented between the square throat 47 and the round pipe 31.

The operation of the waveguide 41 is believed to be clear from the description set out above, but will be briefly summarized at this point. Both pairs of horizontally and vertically polarized transmit and receive signals are fed from and to the waveguide 41 in the feed horn 31.

The polarization junction 43 separates the horizontally polarized receive signals from the vertically polarized receive signals by passing the vertically polarized receive signals straight through the polarization junction and into the leg 61 of the frequency separator 57.

The horizontally polarized receive signals are sent through the H-plane bends 51, E-plane bends 53 and Southworth junction 55 into the leg 73 of the frequency separator 59. The horizontally polarized receive signal is prevented from propagating into the port 77 by the susceptance blocks 87 and flows past the planar filter 83 in the port 81 to the associated receiver unit in the housing 37.

The vertically polarized receive signal is guided to its associated receiver unit at the outlet of the port 69 by the structure of the frequency separator 57 in the same way as described above for the horizontally polarized receive signal.

The horizontally polarized and vertically polarized transmit signals are guided from their respective transmitter units through associated ports 77 and 65 and into the leg portions 73 and 61 of the frequency separators 59 and 57.

The horizontally polarized transmit signal then flows through the Southworth junction 55, the E-plane bends 53, the H-plane bends 51 and into the junction 43 and then from the junction 43 to the feed horn 31. The vertically polarized transmit signal flows through the port 65, through the susceptance blocks 85, into the leg 61 of the frequency separator 57 and then straight through the polarization junction 43 to the feed horn 31.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims:

We claim:

1. A waveguide apparatus for guiding a first pair of horizontally polarized transmit and receive frequencies independently of and in electrical parallel with a second pair of vertically polarized transmit and receive frequencies between a feed horn and related transmitter or receiver units, said waveguide apparatus being constructed to operate across the 4 to 6 GigaHertz band with a very narrow bandwidth for the transmit frequency and a very narrow bandwidth for the receive frequency and with a single size of rectangular waveguide for separating the transmit and receive frequencies, said waveguide apparatus comprising, polarization junction means connectable to an end of the feed horn and effective to separate the horizontally polarized receive frequency from the vertically polarized receive frequency as the receive frequencies flow from the horn toward the receive units and effective to guide the separated horizontally and vertically polarized transmit frequencies into joint flow through the common feed horn to the antenna, first frequency separating means for separating the vertically polarized pair of transmit and receive frequencies of very narrow bandwidth at opposite ends of the 4 to 6 GigaHertz band into separate flow paths for the transmit and receive frequencies at one end of the separating means and effective to maintain electrical isolation between the associated transmitter and receiver units while guiding the frequencies to and from the polarization junction means through a common flow path at the other end of the separating means, second frequency means for separating the horizontally polarized pair of transmit and receive frequencies of very narrow bandwidth at opposite ends of the 4 to 6 GigaHertz band into separate flow paths for the transmit and receive frequencies at one end of the separating means and effective to maintain electrical isolation between the associated transmitter and receiver units while guiding the frequencies to and from the polarization junction means through a common flow path at the other end of the separating means, and wherein the separate flow paths for the transmit and receive frequencies in the first and second frequency separating means are rectangular and have the same internal height and width dimensions so that a single size of waveguide separates the transmit and receive frequencies, and coupling means connected between the polarization junction means and the second frequency separating means for guiding the horizontally polarized transmit and receive frequencies between the second frequency separating means and the polarization junction means.

2. The invention defined in claim 1 wherein the coupling means include two, symmetrical 180° H-plane bends with each bend having a first end connected to a related side of the polarization junction means.

3. The invention defined in claim 2 wherein the coupling means further include two 90 degree E-plane bends and a junction with one end of each E-plane bend connected to a second end of a related H-plane bend and with the other end of the E-plane bend connected to the junction.

4. The invention defined in claim 3 wherein the H-plane bends and E-plane bends are symmetrical and substantially eliminate spurious frequency modes in the frequency bands of interest while providing a coupling flow path that is physically short and structurally robust.

5. The invention defined in claim 1 wherein the polarization junction means include a waveguide which has a square configuration at the end connectable to the feed horn to permit simultaneous propagation of both senses of polarization and wherein the dimensions of the square waveguide of the junction are related to the dimensions of a circular feed horn so that the wave impedance at the transmit and receive frequencies flowing through the junction are almost identical to the wave impedance of the circular pipe of the feed horn and impedance matching structure need not be implemented between the square waveguide of the junction and the circular pipe of the feed horn.

6. The invention defined in claim 1 wherein the polarization junction means include a throat, two side ports and septum means in the throat for dividing the E-field of the horizontally polarized receive frequency in two equal parts while turning each of the two parts of the E-field 90° from the direction of flow from the feed horn to a related side port connected to the coupling means.

7. The invention defined in claim 6 wherein the septum means are effective to pass the vertically polarized frequencies in a straight line through the throat.

8. The invention defined in claim 6 wherein the coupling means include two H-plane bends each having one end connected to a related port of the junction means and including vane means in each port for allowing horizontally polarized frequencies to pass through the vane means while the vane means appear as a short circuit to the vertically polarized frequencies.

9. The invention defined in claim 1 wherein each of the first and second frequency separating means has a generally Y shaped configuration with a leg portion of the Y constructed to guide both of the commonly polarized transmit and receive frequencies and with a first branch port of the Y constructed to guide the transmit frequency and a second branch port of the Y constructed to guide the receive frequency.

10. The invention defined in claim 9 wherein each leg portion of the first and second frequency separating means is square shaped in cross section and is tapered inwardly from its outermost end to the junction of the leg with the transmit and receive ports to provide a cut off waveguide condition for any orthogonally polarized signals.

11. The invention defined in claim 9 including filter means in the receive port only of each of the first and second frequency separating means for passing the receive frequencies and for appearing as a short circuit to the transmit frequency to thereby provide sufficient attenuation of the transmit frequency energy to isolate the transmitter unit from the receiver unit.

12. The invention defined in claim 11 wherein the filter means comprises a thin rectangular strip with bandpass structure in the form of thin wires and bandstop structure in the form of cut-outs interspersed in the metal strip.

13. The invention defined in claim 11 wherein the filter means is positioned within the receive port to reflect the transmit frequency from the port in waves that are in phase with the transmit frequency in the transmit port.

14. The invention defined in claim 9 wherein the transmit signal frequency is in the range from 5.925 to 6.425 GigaHertz and the receive signal frequency is in the range from 3.7 to 4.2 GigaHertz and wherein each of the ports is a rectangular waveguide having the dimensions 44 millimeters by 20.5 millimeters.

15. The invention defined in claim 14 wherein the leg portion of each of the first and second frequency separating means is square shaped in cross section and is tapered inwardly from its outermost end to the innermost end at the junction of the first and second ports to provide, in combination with the ports, a cut-off frequency of 3.4 GigaHertz at the low end while not permitting any higher order modes to propagate until about 6.8 GHz.

16. The invention defined in claim 1 wherein each of the separate flow paths for the transmit and receive frequencies has a ratio of the broad wall dimension to the sidewall dimension equal to 2.2.

17. The invention defined in claim 1 wherein each of the first and second frequency separating means have only a single filter.

18. A waveguide apparatus for guiding a first pair of horizontally polarized transmit and receive frequencies independently of and in electrical parallel with a second pair of vertically polarized transmit and receive frequencies between a feed horn and related transmitter or receive units, said waveguide apparatus being constructed to operate across the 3.7 to 6.425 GigaHertz band with a very narrow bandwidth for the transmit frequency and a very narrow bandwidth for the receive frequency and with a single size of rectangular waveguide for separating the transmit and receive frequencies, said waveguide apparatus comprising, polarization junction means connectable to an end of the feed horn and effective to separate the horizontally polarized receive frequency from the vertically polarized receive frequency as the receive frequencies flow from the horn toward the receiver units and effective to guide the separated horizontally and vertically polarized transmit frequencies into joint flow through the common feed horn to the antenna, said polarization junction means including a throat, two side ports and septum means in the throat for dividing the E-field of the horizontally polarized receive frequency in two equal parts while turning each of the two parts of the E-field 90 degrees from the direction of flow from the feed horn to a related side port, said septum means being effective to pass the vertically polarized frequencies in a straight line through the throat, first frequency separating means for separating the vertically polarized pair of transmit and receive frequencies of very narrow bandwidth at opposite ends of the 3.7 to 6.425 GigaHertz band, second frequency separating means for separating the horizontally polarized pair of transmit and receive frequencies of very narrow bandwidth at opposite ends of the 3.7 to 6.425 GigaHertz band, each of the first and second frequency separating means comprising, a generally Y-shaped waveguide having a leg portion for guiding both the transmit and the receive frequencies, a first branch providing a port for the transmit frequency, a second branch providing a port for the receive frequency, and a junction at which the transmit port, the receive port and the leg portion of the Y-shaped waveguide join together, filter means in the receive port only and having band pass structure for passing the receive frequency and band stop structure for stopping the transmit frequency, susceptance block means in the transmit port for narrowing down the waveguide, and therefore increasing the cut-off frequency, to prevent receive frequency energy from propagating through the transmit frequency port, tuning screws associated with the susceptance block means for providing compensating susceptance to balance out the susceptance introduced by the block means, coupling means connected between the ports of the polarization junction means and the second frequency separating means for guiding the horizontally polarized transmit and receive frequencies between the second frequency separating means and the polarization junction means, said coupling means including two, symmetrical 180 degree H-plane bends with each bend having a first end connected to a related port of the polarization junction means, two 90 degree E-plane bends and a junction with one end of each E-plane bend connected to an end of a related H-plane bend and with the other end of the E-plane bend connected to the junction, and wherein the junction is connected to the leg portion of the second frequency separating means and the leg portion of the first frequency separating means is connected to the throat of the polarization junction and wherein all the ports in the Y-shaped waveguides for the first and second frequency separating means are rectangular and have the same internal height and width dimensions.

19. A frequency separator waveguide apparatus constructed to operate across the 4 to 6 GigaHertz band with a very narrow bandwidth for the transmit frequency and a very narrow bandwidth for the receive frequency and with a single size of rectangular waveguide for separating the transmit and receive frequencies, said waveguide apparatus comprising, a generally Y-shaped waveguide having a leg portion for guiding both the transmit and the receive frequencies, a first branch providing a port for the transmit frequency existing in a very narrow bandwidth at one end of the 4 to 6 GigaHertz band, a second branch providing a port for the receive frequency existing in a very narrow bandwidth at the opposite end of the 4 to 6 GigaHertz band, and a junction at which the transmit port, the receive port and the leg portion of the Y-shaped waveguide join together, filter means in the receive port only and having band pass structure for passing the receive frequency and band stop structure for stopping the transmit frequency, and wherein each port is rectangular shaped and has the same internal dimensions as each other port and the ratio of the broadwall to the narrow wall of each port equals 2.2.

20. The invention defined in claim 19 wherein the filter means comprise a thin rectangular strip with band pass structure in the form of thin wires and band stop structure in the form of cut-outs interspersed in the metal strip.

21. The invention defined in claim 19 wherein the transmit signal frequency is in the range from 5.925 to 6.425 GigaHertz and the receive signal frequency is in the range from 3.7 to 4.2 GigaHertz and wherein each of the ports is a rectangular waveguide in cross section having the dimensions 44 millimeters by 20.5 millimeters, whereby the dimensions are such that second order modes are cut off for frequencies below 6.8 GigaHertz, thus providing a unique operating frequency band and waveguide over the range from 3.7 GigaHertz to 6.425 GigaHertz.

22. The invention defined in claim 21 wherein the leg portion is square shaped in cross section and is tapered inwardly from its outermost end to the junction to provide, in combination with the port dimensions, a cut-off frequency of 3.4 GigaHertz, thus preventing any propagation of orthogonally polarized signals incident at the square input.

* * * * *